United States Patent [19]

Axford

[11] Patent Number: 4,551,956

[45] Date of Patent: Nov. 12, 1985

[54] GUTTERING SYSTEM

[76] Inventor: Wayne L. Axford, 19 Blanch St., Oatley, New South Wales, 2223, Australia

[21] Appl. No.: 514,880

[22] Filed: Jul. 18, 1983

[30] Foreign Application Priority Data

Jul. 19, 1982 [AU] Australia ..... 4937

[51] Int. Cl.[4] ..... E04D 13/00

[52] U.S. Cl. ..... 52/12; 52/14; 210/163; 210/164

[58] Field of Search ..... 52/11, 12, 14, 16; 210/163, 164

[56] References Cited

U.S. PATENT DOCUMENTS

| | | | |
|---|---|---|---|
| 2,271,081 | 1/1942 | Layton | 52/12 |
| 2,847,949 | 8/1958 | Pond | 52/12 |
| 3,212,416 | 10/1965 | Boersma | 210/163 |
| 3,436,878 | 4/1969 | Singer | 52/12 |
| 3,824,749 | 7/1974 | Scherf | 52/11 |
| 4,261,143 | 4/1981 | Rizzo | 52/11 |

FOREIGN PATENT DOCUMENTS

| | | | |
|---|---|---|---|
| 25583 | 11/1969 | Australia | 52/11 |
| 405633 | 8/1948 | Canada | 210/163 |
| 34140 | 8/1981 | European Pat. Off. | 52/11 |

*Primary Examiner*—Henry E. Raduazo
*Attorney, Agent, or Firm*—Ladas & Parry

[57] ABSTRACT

A guttering system including shallow channel portion which receives run off from a roof from which it is attached. The shallow channel is part of a length of formed metal sheet which wraps around in an approximate "C"-shape to provide fascia and if required eaves. Supported within the formed metal sheet and situated below the shallow channel is a plastics conduit, such as PVC channel, which leads to down pipe. Spaced along the shallow channel are through holes, with strainers, which allow water collected to pass through into the conduit and then to the down pipe. The formed metal sheet and conduit are both supported by plurality of spaced apart brackets which can be attached on top of, or alongside, roofing structures such as rafters. The brackets need not to be attached in a specific location relative to the rafter ends, and the rafter ends need not to be cut plumb.

11 Claims, 13 Drawing Figures

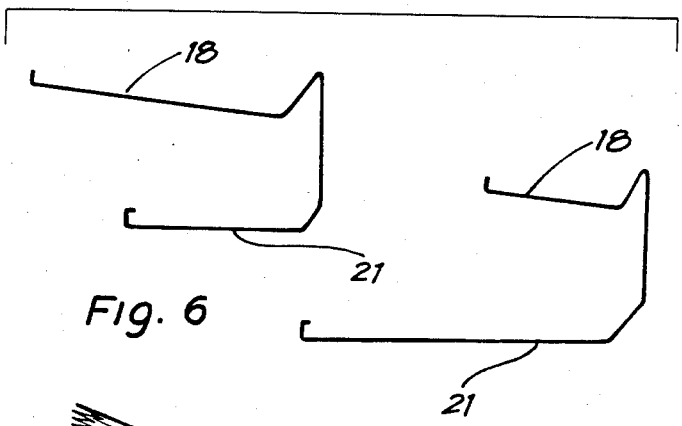
Fig. 6
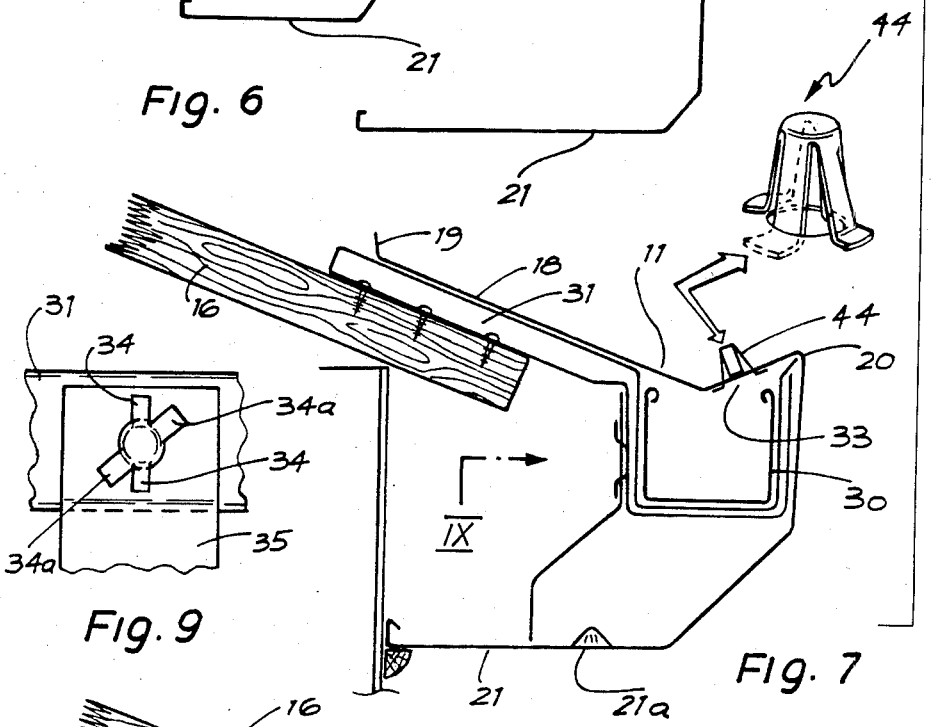
Fig. 7
Fig. 9
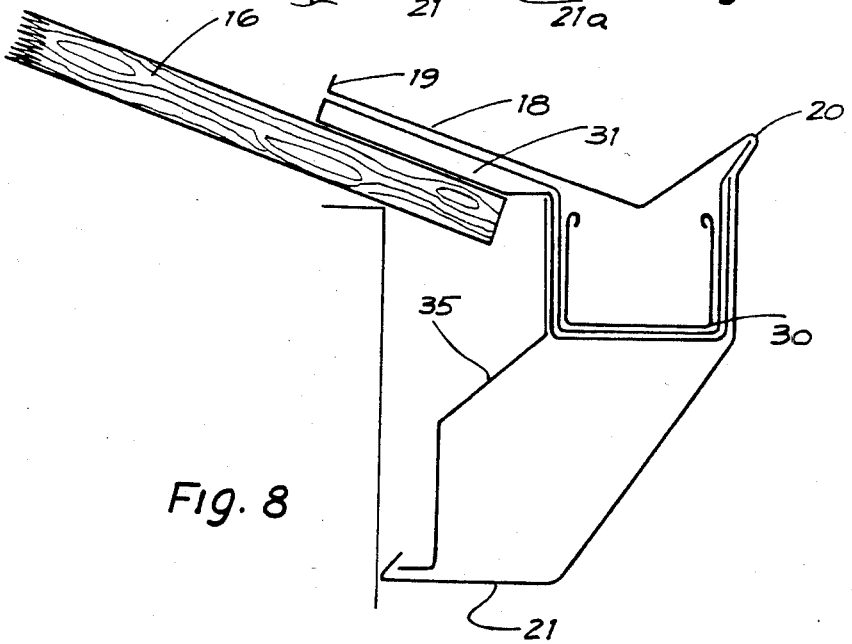
Fig. 8

GUTTERING SYSTEM

This invention relates to roof guttering especially such guttering which is used on households and similar sized conventional roofs. Of course by selection of size the guttering can be used on any sized building and it may be used on new buildings or as a replacement of existing guttering.

Conventional guttering used for this purpose suffer some defects. Known gutters generally comprise a long substantially deep channel which is attached to fascia board proximate the edge of the roof. The channel must have a slope so that water trapped therein will flow to preformed openings adapted to be fitted to downpipes. In order to obtain this slope the support brackets must be carefully aligned before nailing them to the fascia of the building. This is a time consuming portion of installation. Ensuring that the correct slope or fall is used involves a somewhat tedious installment method. This fall can be upset if the building settles non-uniformly and in such case it is often necessary to re-install the gutter. This often results in an unpleasant appearance as the gutter may be at a distinct angle to the general roof line. Further, known gutters usually have an outer upper edge somewhat higher than the inner, or house side, upper edge. If the gutter becomes blocked and overflows the overflow is directed toward the house and may enter through the eaves and dampen the inner wall sections. The relatively deep nature of the channel, and the overhang of the roof into the channel, causes leaves and light twigs to become easily entrapped causing possible blockages and silting up, and preventing sun and wind from cleaning the gutter. These characteristics also make manual cleaning very difficult. This increases the chance of the gutter overflowing during rain and also absorbs moisture thus exposing the guttering to water contact (and corrosion) for substantially longer periods of time. Dried leaves and twigs in the gutter region produce fire hazards in some areas.

It is therefore an object of the present invention to provide guttering, and a method of installing same, which will ameliorate, or at least substantially overcome, the disadvantages of the foregoing prior art.

Accordingly in one broad form the invention provides a roofing gutter comprising: an upper shallow channel portion; a conduit running proximate the underside of the channel portion and adapted to have a pre-determined slope relative to said channel; and liquid communication means between the channel portion and the conduit.

In a further broad form the invention provides a method of installing the before described guttering comprising the steps of: attaching to appropriate roof members support brackets adapted to support the conduit and the channel in their before described relative position; bending the brackets until they are in a predetermined orientation which ensures correct setting of the gutter; and placing the roofing gutter on the brackets to be supported thereby.

In a third broad form of the invention the before described gutter is installed on a building with the upper most edge of the house side of the channel above the upper most edge of the outer side of the gutter.

The present invention provides advantageous features over known gutters as described hereafter.

The gutter may include an eaves portion running substantially parallel to the channel portion and located beneath the conduit so that upon installation the house side edge of the eaves portion is held firmly against the adjacent wall of the building to which the gutter is installed. Thus, the eaves portion may form a secondary gutter channel for the capture of overflow water from the conduit and accordingly should include drain apertures to drain such overflow water away from the wall.

The conduit may be produced from proprietary piping, e.g. PVC piping of a size according to requirements, and the communication means between the piping and the shallow channel may include filters or screens. The shallow nature of the channel provides good drying and self cleaning, with the help of the wind, of leaves and other material which tend to collect in conventional gutters. The present invention therefore reduces fire hazard and maintenance.

An extended form of the above described gutter may be supported by brackets which extend the gutter outwardly from the roof members without structural alteration to the roof. The gutter may be altered in size accordingly so as to form extended eaves. There is no need for other eave coverings or fascia board as the present invention can provide both. The ability to extend the eaves beyond the normal amount provides obvious economical advantages over prior gutters. The eaves extension may also be accomplished using a standard sized gutter by producing the gutter shape in a different portion of the sheet from which it is being produced. In buildings of brick outer walls the eaves sit over the top course of bricks.

It is possible to use cantilever brackets pivotally attached to the roof members and engaging a portion of the gutter, preferably a portion of an eaves portion of the gutter, and upon levering the cantilever bracket the gutter is moved into its correct installed position. Thus the present gutter, although larger than conventional gutters, is easily installed by a few people.

Once the gutter is installed as described above the conduit may be moved slightly within the assembled gutter so as to introduce a fall if desired. Fall is not essential to the present gutter as it is to known gutters as the gutter of the invention will function satisfactorily when installed horizontal, however fall is more easily obtained to the desired degree as it may be "fine tuned" after installation.

Preferred embodiments of the present invention will now be described with reference to the accompanying drawings in which:

FIGS. 3 to 6 are similar views to FIG. 1 showing different arrangements according to the invention; and FIGS. 7 to 12 show views similar to FIG. 1 but of an alternative embodiment.

Figure 1:
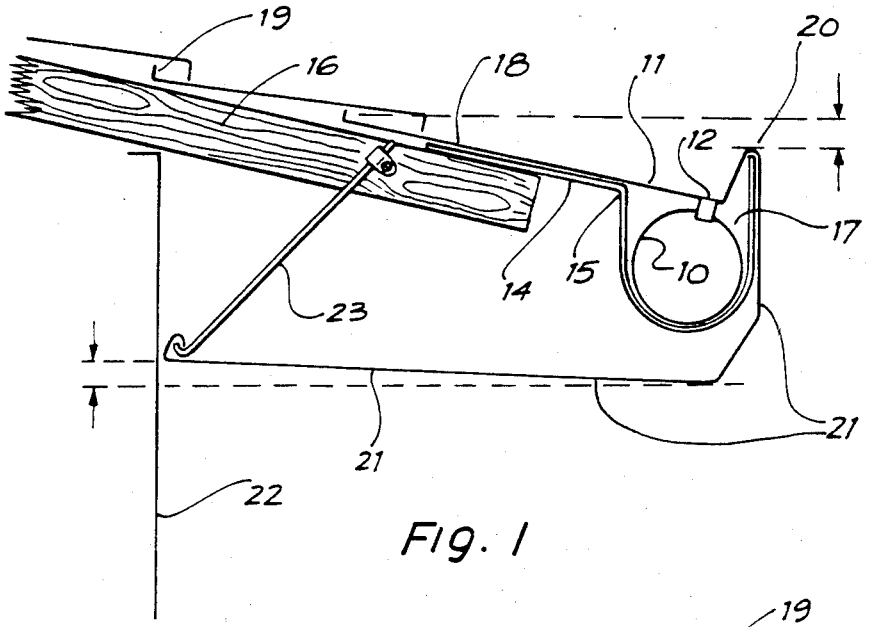
FIG. 1 is a sectional view of a gutter according to the present invention when installed.
Figure 2:
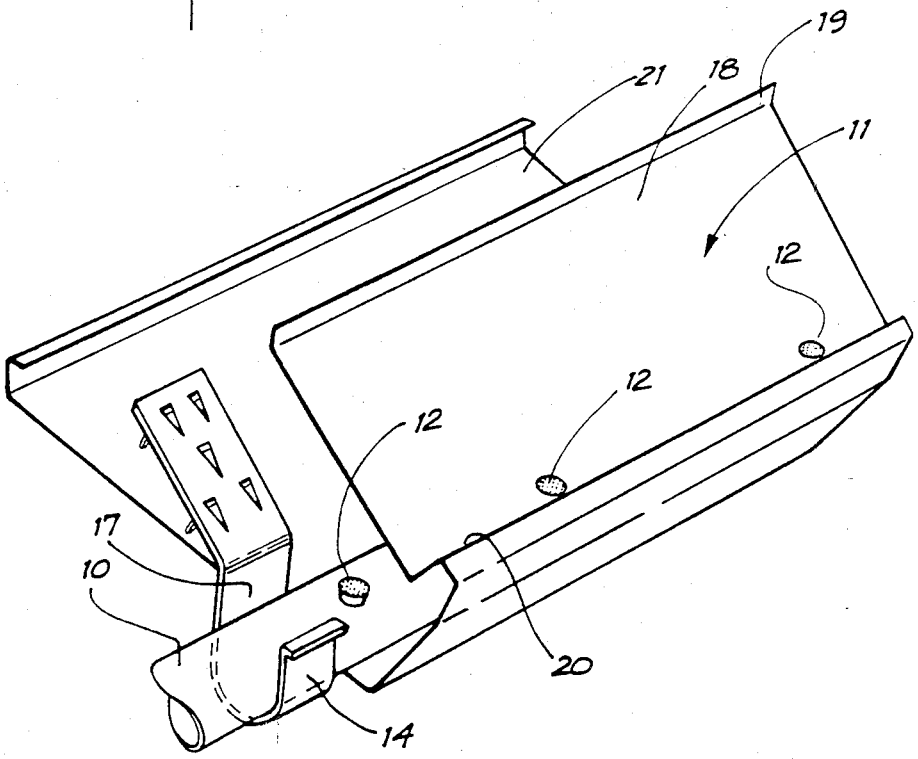
FIG. 2 is a perspective view showing hidden detail of the gutter of FIG. 1.
Figure 3:
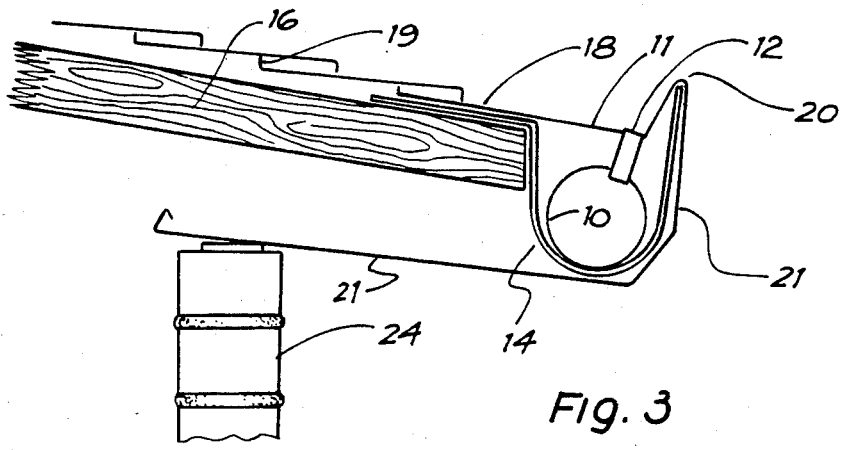

FIG. *7a* shows a channel-shaped bracket.

One embodiment of the invention is shown in FIGS. 1 to 6 and incorporates a conduit of circular cross-section. This embodiment uses suitably sized tubing such as PVC pipe 10 running substantially horizontally below the shallow gutter 11 which is produced in protectively coated high tensile steel, aluminium alloy, plastics or other suitable material. Small draining tubes 12 fitted with strainers (not shown) are inserted into the pipe 10 and extend to the surface of channel 11 so that any water falling into the channel may then proceed into the pipe 10 and thus be carried off.

When installed pipe 10 and channel 11 are fully supported by brackets 14. These brackets are attached to roofing members 16 by nails or other conventional means. Brackets 14, at location 15, are bent after securing to the roofing members 16 until the channel 17 of the brackets faces substantially vertically upwards. If the rafter ends are plumb cut, or if fascia board is attached, brackets 14 can be attached as in FIG. 3 or 4. Pipe 10 and channel 11 can then be supported by the brackets. With the brackets 14 preset in this manner the channel 17 is automatically held in the correct position.

Extending toward the house from channel 11 is an inclined plate section 18 which terminates at lip 19. This plate 18, once installation is completed, is located beneath the roofing material, i.e. tiles, corrugated iron or aluminium sheeting, and may be attached to brackets 14 or roof members 16. When installed the height of lip 19 is somewhat greater than the height of the external edge 20 so that if overflowing occurs water cannot enter the building to which the gutter is attached.

Wrapping around the outside of the gutter, extending from edge 20 to below pipe 10 and towards the wall 22 of the building is an eaves-fascia section 21. The house side of section 21 is held in position by a cantilever type device 23. This ensures that the inner most edge of section 21 is held firmly against the wall 22 of the building. Furthermore, upon installation cantilever 21 can be manually rotated by workmen to assist in installation of the guttering. The eaves-fascia section 21 is preferably shaped so as to form a secondary gutter which will capture any water overflowing from pipe 10 and channel it safely away from wall 22. Drainage apertures of some sort must therefore be provided in some low portion of this secondary gutter. Through holes for downpipes, or the joins at corners or adjacent lengths may form this purpose though specially prepared holes can be used.

Corners are easily constructed by joining abutting ends of the steel portions, the join comprising adjacent sections being alternatively overlapped and underlapped, and fitting proprietary PVC fittings to pipes 10. The join can be pop-rivitted for strength and preferably is sealed beforehand using for example silicon rubber.

In certain installations it is desirable to have the gutter extended somewhat away from the roof members 16. In these situations elongated support brackets 14 can be used to provide the desired extension. These may require to be of increased strength compared to the standard brackets 14. Similarly the eaves-fascia portions 21 can also be varied in size as required. This can be done by selecting strips of varying width to be used as the raw material for the gutter, or by forming the gutter in a different lateral portion of the strip of raw material. The later method is depicted in FIG. 6 and shows how eaves portion 21 can be reduced by an amount equal to the increase in section 18 resulting in the depicted change in geometry.

Where the building is brick veneer or double brick the end of the eaves portion 21 may sit above the top course of the bricks of outer brick wall 24.

Figure 4:
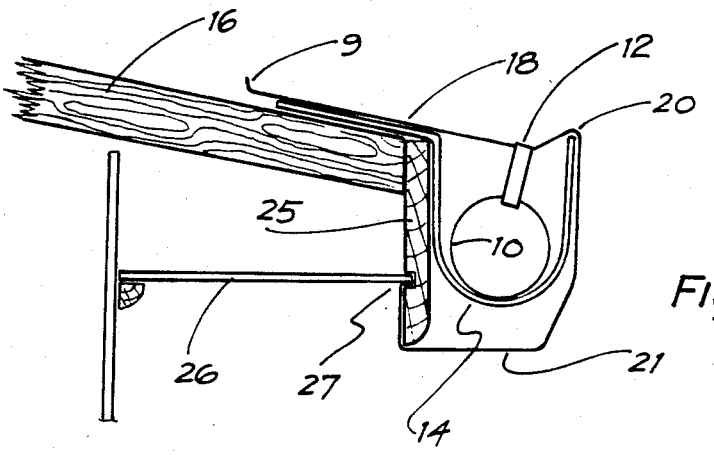

FIG. 4 shows the gutter attached to a building which already includes conventional fascia 25 and eaves 26. In fascia 25 is the normal locating groove 27 into which the outer edge of eaves 26 extends to be supported thereby. The inner end of eaves portion 21 of the gutter is bent so as to be also placed in groove 27 and thus provide a downwards force at point 20 so as to securely hold the gutter in place.

Figure 5:
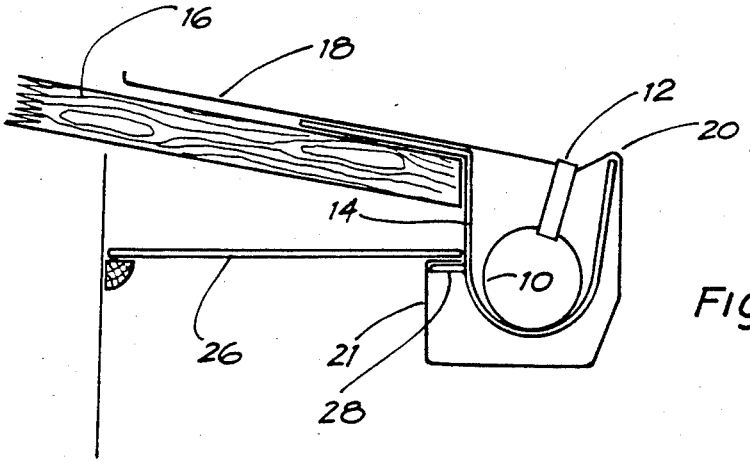

FIG. 5 is a similar installation to that of FIG. 4 but is used when no conventional fascia is erected. Bracket 14 is seen to include a protruding tag 28 adapted to perform the above described tasks of groove 27.

The before described guttering system provides a number of advantages over prior known roofing gutters. Installation is simplified greatly as the gutter may be installed horizontal and the support brackets allow for their attachment to the building and then bending into place so as to assure the correct slope of the gutter. No lining up of supports is necessary as the natural alignment of the roof is used. A fall, if desired, may be introduced by twisting the gutter as desired to give the final bend to the brackets. The shallow upper channel 11 will self-clean thus preventing the build up of leaves, twigs and silt. The gutter does away with the need for fascia boards and covered in eaves sections as the preferred device of the invention completely seals off the building between the roof and wall. The long length of section 18 means that most installations using tiled roofing the roofing portion can be finished off with a whole tile and there is no need to cut tiles along the last row of the roof. Due to the construction of this guttering system fall is not essential. Downpipes can be attached using proprietary PVC joins wherever required. Pipe 10 may be connected to pipes 10 of other gutters, thus only one drainage pit is required. Also, as the present gutter includes three gutter portions, it generally has a much higher carrying capacity compared to existing systems.

Figure 7A:
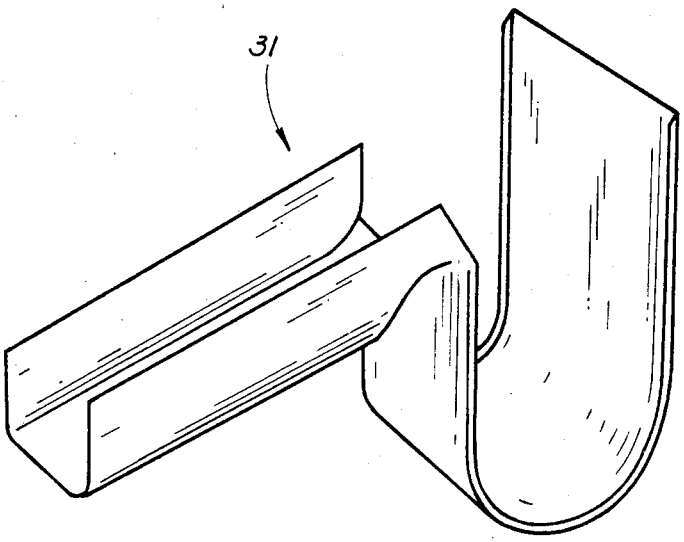

A second embodiment of the invention is shown in the drawings 7 to 12 and incorporates a conduit of substantially U-shaped cross-section. FIG. 7 shows such embodiment including PVC channel 30 supported by bracket 31 which has been nailed to a rafter 16. Bracket 31 also supports shallow gutter 11 which is substantially the same as that described beforehand.

Bracket 31 shown in FIG. 7 can be seen to differ in some detail from bracket 14 of the earlier described embodiment. The portion of bracket 31 which is attached, for example by nailing, to rafter 16 includes a substantial channel section for improved strength. Further the channel shape of the attachment portion of bracket 31 allows the bracket to be attached to a vertical side of a structure such as rafter 16. This attachment portion of bracket 31 may be produced in any length allowing the gutter to be extended, basically as described in the earlier embodiments, a substantial distance from the existing roof construction.

As with the earlier described embodiment the outer edge line of shallow channel 11 rests on an extreme tip of bracket 31. Extending toward the house, and sloped upwardly from the lowest line of shallow channel 11, is an inclined plate section 18 terminating at a lip 19. An important feature of this invention is that once installed lip 19 is higher than edge 20 so that in the event of overflow of shallow channel 11 water will not enter the building to which the guttering is attached.

To allow water to communicate from shallow channel 11 into conduit 30 holes 33 proximate the lowest portions of channel 11 are included. In order to prevent large objects such as leaves, berries and sticks from travelling through holes 33 and possibly blocking the gutter system strainers 44 are attached. Strainers 44 are simply produced from sheet metal to include four generally downwardly extending legs, each leg having a small tab bent outwardly therefrom. One pair of opposite tabs are held above the plate of channel 11 while the other opposite pair of tabs are held under the plate of channel 11 when strainer 44 is in position.

As previously mentioned shallow channel 11 can continue from edge line 20 to wrap down and under the general gutter structure so as to form eaves portion 21. Within eaves portion 21 are included small domes including holes or slits to form filter drains 21*a*. Normally no water carries through filter drains 21*a* unless for example conduit 30 overflows due to perhaps heavy rainfall.

FIG. 8 shows the embodiment of FIG. 7 in use where no extended eaves portions are required. Support bracket 35 is attached to an inside of bracket 31 and extends generally downwardly so as to be connected to, and to support, the houseside edge of eaves portion 21. The preferred attachment means of bracket 35 to bracket 31 is shown in FIG. 9. Bracket 31 includes two tangs 34 which may pass through cooperating holes 34 A in bracket 35 when the two brackets are suitably orientated. By simply rotating bracket 35 it is firmly attached to bracket 31.

Figure 10:
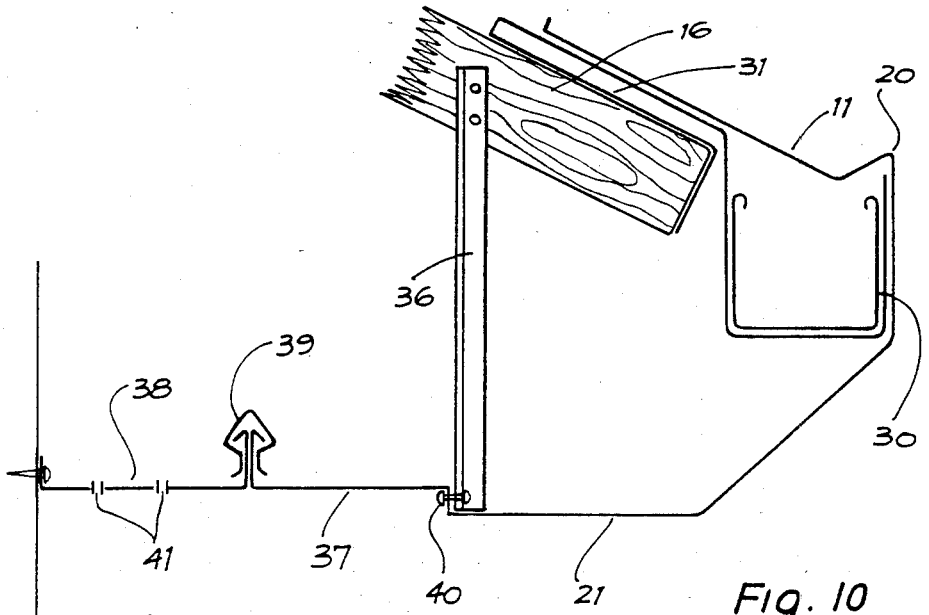
Figure 11:
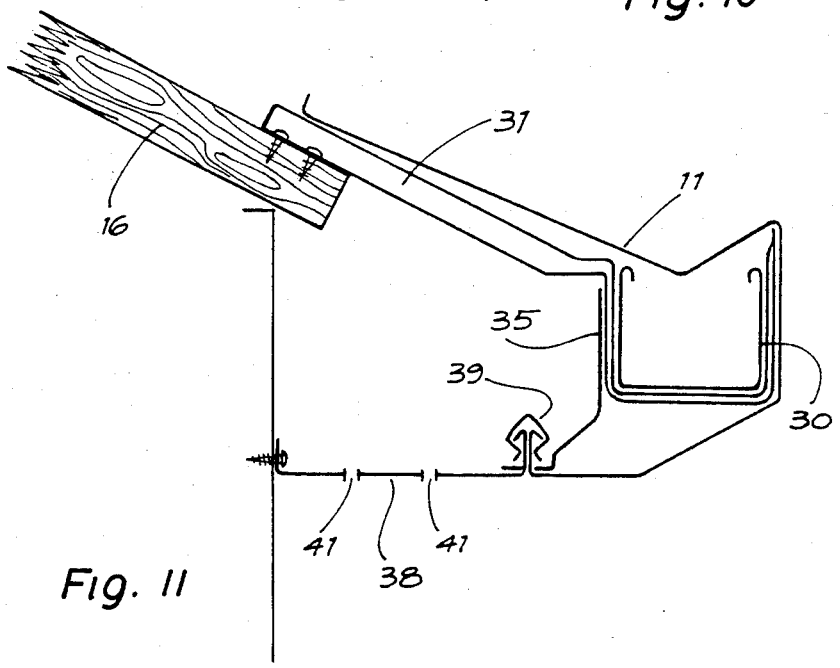

FIG. 10 shows the gutter in use where large eaves have been designed into the original building structure. A support bracket 36 extends from any convenient structure, for example rafter 16, downwardly to support eaves portion 21 of the gutter system. Bracket 36 is attached to eaves portion 21 at a small vertical ridge section 40. As well as ridge section 40 providing a convenient attachment point for this purpose it also serves to cut down any vibration in the eaves portion 21 which may be caused by strong winds. Such vibrations if allowed can produce an annoying noise. As shown in the embodiment of FIG. 10 eaves portion 21 of the gutter system extends well beyond the ridge 40 by virtue of section 37. Further extension of the eaves is provided by separate strip 38 which includes a number of airvents 41 punched therethrough. Strip 38 is attached to the portion 37 of the gutter system by any convenient clip 39. The houseside end of strip 38 is then for example nailed to existing building structure. FIG. 11 shows an embodiment of the invention where the gutter system has been used to provide extended eaves where the original structure of the building was not so designed.

Figure 12:
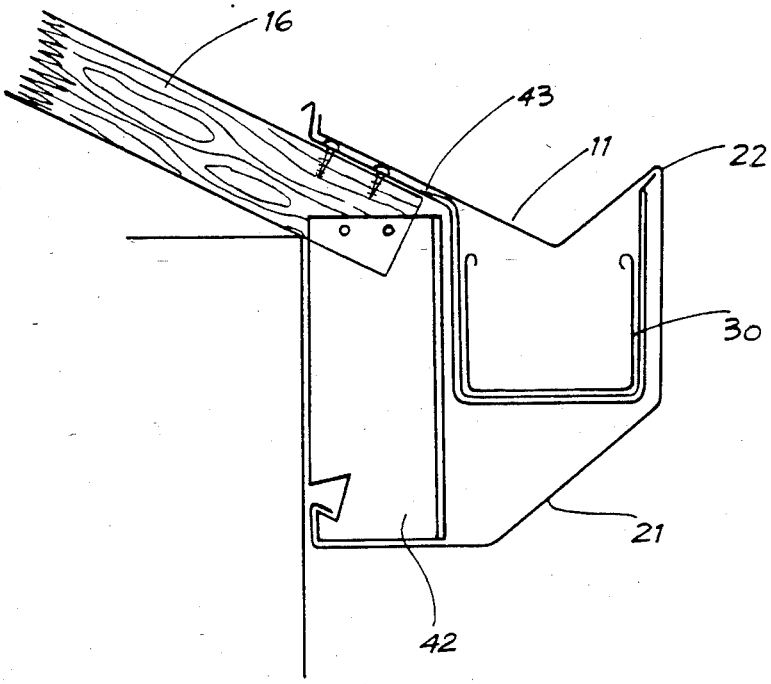

FIG. 12 shows an embodiment of the invention which includes a bracket 43 in place of the previously described bracket 31. As can be seen in FIG. 12 bracket 43 is of a less substantial nature and does not include the channel shaped attachment portion that distuingishes bracket 31. However in common with bracket .31 bracket 43 includes an outward upper edge for support of shallow channel 11 at its line 22. In this embodiment a more substantial bracket 42 is used not only to support the eaves section 21 of the gutter structure but also to provide additional support for bracket 43 and therefore the gutter system as a whole. Bracket 42 is of a generally angular, or "L" shaped cross-section. Bracket 42 is again attached to for example rafter 16 by convenient means such as nails.

Although not shown in the drawings, it is preferred that the down pipe used in conjunction with the present invention is a PVC conduit enclosed within steel sheet such as that used to construct channel section 11. At a low region of the down tube proximate the ground a T junction is advantageously incorporated therein with the transverse branch thereof being horizontal and incorporating a one way valve allowing only the exit of water from the down pipe. This arrangement will prevent flooding of the gutter system in the advent of the underground drainage becoming blocked or overwhelmed during heavy rain.

A further preferred feature not shown in the drawings is the provision of a wide inclined plate section 18 with strips of heat absorbing water conveying tubes laid therealong. These heat absorbing tubes may be supplied at one end with mains water and at the other end with temperature sensitive valves so that water will be captured within the tubes until it reaches some preselected temperature when that portion of the water will be allowed to escape the tubes and be directed into some insulated storage unit or provided for immediate use. Such a system might be made up of a varying number of batteries of heat absorbing tubing, each battery having a different aspect and being therefore heated efficiently at different times of the day. The battery in use at any one time can therefore be selected by merely switching appropriate taps.

As will be appreciated by those familiar with existing gutter systems, the present invention provides numerous advances in the art.

When using brackets such as bracket 31, attachment may be made to the side of rafters where this is desired. Further, the fall of the conduit which carries the run off to the down pipe may be easily and accurrately adjusted at the time of installation or afterwards. This is particularly important as buildings often settle somewhat which may necessitate these changes. This "fine tuning" of the fall can be simply accomplished by packing between the conduit and support brackets.

The present gutter system is less likely to chemical attack as the shallow nature of the metal channel means long exposure to sunlight and hence a dry environment. Thus acidic pollution which may land in the gutter has no chance of acting on the metal as it will only be dissolved during rain when it is simply washed away.

What is claimed is:

1. A gutter system comprising: a plurality of support brackets each including an attachment portion at one end for attachment to roof structure, a support edge at the other end and a generally "U"-shaped support portion therebetween in proximate said other end; a conduit for liquid transportation supported by said support brackets within said "U"-shaped support portions; a sheet metal outer shell portion wrapping around said support brackets and conduit and supported at an outer longitudinally running ridge by said support brackets at least at their support edges; a shallow channel portion formed longitudinally along an upper portion of said outer shell portion and adapted to receive water runoff from a building roof and to channel the water therealong between a plurality of substantially spaced apart liquid communication means providing drainage of water from said shallow channel portion to said conduit.

2. A gutter system as claimed in claim 1 wherein said outer shell portion includes a lower section below said conduit adapted to form eaves, said eaves being of selectable width by forming the shape of said outer shell portion in a preselected location in the original metal sheet in which it is produced.

3. A gutter system as claimed in claim 2 wherein said eaves include drain holes and are adapted to form an overflow gutter to prevent excess water from said conduit entering the building to which said gutter system is attached.

4. A gutter as defined in claim 2 wherein the building side of said shallow channel is higher than the opposite outer side of said shallow channel.

5. A gutter as defined in claim 1 further including a strainer positioned in each said communication means, said strainer being produced from a single sheet of material and comprising:

a head portion; and four leg portions extending out of the plane of said portion and each including an angled tab at respective ends opposite said head portion, wherein said strainer is maintained in position by having two opposite once of said tabs below the surface of said channel and two above.

6. A gutter system as claimed in claim 1 wherein said shell portion includes an inclined plate section extending beneath the outer surface of a building's roof and attached to the roof structure.

7. A gutter system as claimed in claim 1 wherein said shell portion includes an inclined plate section extending beneath the outer surface of a building's roof and attached to ones of said support brackets.

8. A gutter system as defined in claim 1 wherein said attachment portion is of an elongate channel shape in the direction perpendicular to said "U"-shaped portion.

9. A gutter system as claimed in claim 1, wherein said shell portion includes an inclined plate section extending beneath the outlet surface of a tiled roof of a building, the inclined plate section terminating along a longitudinal edge at a lip extending a short distance upwardly and engaging the underside of the roofing tiles.

10. A gutter system as defined in claim 9 wherein said support bracket, at a section of said "U"-shaped portion proximate said attachment portion, is supported transversely preventing bending of said support bracket downwardly and inwardly towards the building to which the system is attached.

11. A method of installing a gutter system, said gutter system comprising a plurality of support brackets each including an attachment portion at one end for attachment to roof structure, a support edge at the other end and a generally "U"-shaped support portion therebetween in proximate said other ends; a conduit for liquid transportation supported by said support brackets within said "U"-shaped support portions; a sheet metal outer shell portion wrapping around said support brackets and conduit and supported at an outer longitudinally running ridge by said support brackets at least at their support edges; the method comprising the steps of:

attaching said support members to approximate roof members;

bending the brackets until they are in a predetermined orientation providing correct setting of the gutter; installing said conduit to be supported by said brackets; placing necessary packing between the conduit and the brackets to obtain the desired fall of the conduit; wrapping said outer shell portion around the brackets and conduit to be supported thereby.

* * * * *